US007968779B2

(12) United States Patent
Courtright et al.

(10) Patent No.: US 7,968,779 B2
(45) Date of Patent: Jun. 28, 2011

(54) STRINGED INSTRUMENT CONDITIONING DEVICE

(76) Inventors: Aaron Courtright, Stroudsburg, PA (US); Ronald W. Koller, Palmerton, PA (US)

( * ) Notice: Subject to any disclaimer, the term of this patent is extended or adjusted under 35 U.S.C. 154(b) by 65 days.

(21) Appl. No.: 12/402,180

(22) Filed: Mar. 11, 2009

(65) Prior Publication Data

US 2009/0229445 A1 Sep. 17, 2009

Related U.S. Application Data

(60) Provisional application No. 61/035,641, filed on Mar. 11, 2008.

(51) Int. Cl.
*G10D 3/16* (2006.01)

(52) U.S. Cl. ..... 84/320

(58) Field of Classification Search ..... 84/320–322, 84/327, 329
See application file for complete search history.

(56) References Cited

U.S. PATENT DOCUMENTS 1,871,021 A * 8/1932 Zachrison ..... 84/8
* cited by examiner

*Primary Examiner* — Kimberly R Lockett
(74) *Attorney, Agent, or Firm* — Clinton H. Wilkinson; Charles A. Wilkinson

(57) ABSTRACT

An device for accelerating the conditioning process of a stringed musical instrument by causing such instrument to be continuously strummed and vibrated, whereby such vibrations are transmitted to the wooden body of the instrument, which causes the instrument to be prematurely aged and over time improves the consistency, richness, and quality of the sound produced by the instrument when played.

17 Claims, 5 Drawing Sheets

STRINGED INSTRUMENT CONDITIONING DEVICE

CROSS REFERENCE TO RELATED APPLICATIONS

This application claims the benefit of the filing date of U.S. provisional patent application Ser. No. 61/035,641, filed on Mar. 11, 2008, the disclosure of which is incorporated herein by reference.

BACKGROUND OF THE INVENTION

1. Field of the Invention

The present invention relates generally to the field of devices for improving the tone of musical instruments, and more particularly to a device for prematurely aging and therefore conditioning stringed instruments such as an acoustic guitar to improve the quality of the sound produced by such instrument.

2. Preliminary Discussion and Discussion of Prior Art

It is generally accepted that the more a stringed instrument having a wooden sounding box such as an acoustic guitar or violin is played, the more consistent tones and the richer and better overall sound quality is produced, as compared to newer instruments. The reasons for such improved sound quality with use and age have been the subject of much debate over the years. It is generally believed, however, that over time the vibrations caused by the strings effect the structure and characteristics of the wood, perhaps by modifying the cell structure of the wood and making it more uniform. Others believe that the finish applied to the wood is the most important factor. As a result, the prior art includes numerous devices, compositions, and processes designed to prematurely age the wood of stringed instruments or otherwise treat such instruments in an effort to improve or produce a richer sound quality by the instrument. The following prior art references are exemplary of these efforts.

U.S. Pat. No. 579,605 issued to B. N. Pierce on Mar. 30, 1897 entitled "Apparatus for Perfecting Tones of Musical Instruments" discloses a mechanical device for simulating heavy continuous play of a musical instrument such as a violin. Several instruments are secured side-by-side on a framework, and a plurality of belts are aligned on pulleys and secured to a rocking drum or cylinder so they are continually moved across the strings of the instrument in a reciprocating motion, thereby vibrating the strings and accelerating the aging process of the instrument. The Pierce device differs from the present invention in several ways, as the Pierce device is not portable, is designed to treat several instruments at once rather enabling a single instrument to be continually strummed or played at home by either a professional or recreational musician, and utilizes a different arrangement for vibrating the instrument strings that cannot be adapted for use in the present invention.

U.S. Pat. No. 637,273 issued to M. G. Miller on Nov. 21, 1899 entitled "Guitar Support and Player" discloses a device for playing a guitar using foot pedals. The Miller device includes a fairly complicated mechanism for playing chords and to simulate actual playing, however, and is not designed to continuously strum the strings to condition or prematurely age the instrument as in the present invention.

U.S. Pat. No. 856,533 issued to L. Lawrence on Jun. 11, 1907 entitled "Composition of Matter for Improving the Tone of a Violin" discloses a chemical composition comprised of a mixture of one gallon of alcohol, one pound of gum of guaiac, the peel of three oranges, and two ounces of purified ether.

Such composition is applied on the inside back panel of an instrument for 15-20 minutes, which it is claimed prematurely ages the instrument and improves its tone. While numerous compositions which it is claimed when applied to the wood of an instrument improve its tone are available in the prior art, several additional examples of which are mentioned herein, none of such compositions is similar to the strummer device of the present invention and are merely exemplary of alternative methods for improving the tone quality of an instrument.

U.S. Pat. No. 1,197,116 issued to R. M. Floyd on Sep. 5, 1916 entitled "Method of and Means for Increasing the Resonance of Sound Modifying Wooden Bodies" discloses an apparatus for accelerating aging of stringed instruments by applying a vibration to the instrument without wearing out the strings as would result from continual strumming of the strings. A chamber having several compartments each having an instrument support is provided, which chamber is also filled with a gaseous fluid and kept at a certain temperature. A rubber-tipped applicator connected to a motor drive shaft is then placed in direct contact with each instrument, which applicator when vibrated also vibrates the instrument.

U.S. Pat. No. 1,352,442 issued S. Floresco on Sep. 14, 1920 entitled "Means and Method of Treating Stringed Instruments to Improve Quality of Tone" discloses an instrument treating system and method wherein during building of the instrument a localized pressure greater than the pressure exerted by the regular sized strings is applied to the belly of the instrument in the area where the bridge is to be connected, by securing the instrument to a support and stringing it with large metal strings at such higher pressure. Floresco claims that the localized pressure of the strings on the belly of the instrument through the bridge, caused by playing the instrument over time, is the reason the tone of such string wooden instrument improves over time. The Floresco system is not designed to prematurely age finished guitars as in the present invention, however.

U.S. Pat. No. 1,467,576 issued to M. H. Flydal on Sep. 11, 1923 entitled "Machine for the Purpose of Breaking In or Seasoning Violins" discloses a device comprised of a stationary frame structure for holding several violins, and a movable frame connected to a drive mechanism for holding the bows for such instruments. When the drive mechanism is activated, the movable frame oscillates or vibrates, causing the bow to be continually moved across the strings. While Flydal thus teaches a device for prematurely aging several stringed instruments simultaneously essentially by continually playing the instruments, such device is not designed for home or individual use by recreational musicians, and does not operate in the same manner as the present invention.

U.S. Pat. No. 1,622,484 issued to P. Bamberger on Mar. 29, 1927 entitled "Process for Improving the Tone of Stringed Instruments" discloses another composition for treating the wood of a stringed instrument to improve its tone, which composition is applied prior to shellacking or is mixed with the shellac during building of the instrument, and is comprised primarily of the juices of vegetables, such as onion juice, benzene or kerosene, and zinc chloride.

U.S. Pat. No. 1,691,506 issued to J. B. Wolfe on Nov. 13, 1928 entitled "Stringed Instrument Player" discloses another mechanical device for enabling a musician to play a stringed instrument using his or her feet via several foot pedals. Similar to the Miller patent discussed above, although Wolfe teaches a mechanical device for use in playing a stringed instrument, such device is designed to pluck individual strings rather than to strum all of the strings and thus is unlike the present invention.

U.S. Pat. No. 1,836,089 issued to E. O. Schweitzer on Dec. 15, 1931 entitled "Method of Treating Acoustical Members and the Article Produced Thereby" discloses a process whereby the wood of a violin or other instrument such as a guitar is placed in a cabinet and subjected to ultra violet light or other "chemically active rays". Schweitzer indicates that the rays decompose the gums and resins in the wood and therefore ages the wood, so that a better tone is produced by the instrument.

U.S. Pat. No. 2,547,919 issued to A. Dalmas on Apr. 10, 1951, entitled "Process for Improving the Tone Quality and Resonance of String Instruments" discloses a stringed instrument forming process wherein first the wood is softened by boiling, and then the softened wood pieces are placed between curved surfaces having the desired shape, and subjected to a uniform pressure of about 25 pounds per square inch for several weeks or months, at a low heat. Dalmas claims that boiling removes water soluble substances from the wood and gives the wood cells a more uniform cell size and density, which improves tone quality. Such method is unlike the strummer device of the present invention, however.

U.S. Pat. No. 2,911,872 issued to W. Carl on Nov. 10, 1959 entitled "Violin Breaking-In Apparatus" discloses a motorized device for automatically breaking in and prematurely aging a violin, wherein two violins are clamped to the device, the bows are positioned over the strings, and a motor is energized which causes a gear shaft to rotate and move the bows back and forth in an arcuate path across the selected strings. The Carl device although similar in purpose to the present invention is structurally complicated and comprised of a large number of parts, while the present inventors strummer device has a much simpler construction and is significantly easier to set up and operate.

U.S. Pat. No. 4,822,690 issued to E. A. Wahl on Apr. 18, 1989 entitled "Violin Finish and Finishing Method" discloses another composition for improving the tone of a violin comprised of a first layer of pigment, a second layer of an alcohol based finish including a dye, and a third layer of a spirit based finish also including a dye.

U.S. Pat. No. 5,031,501 issued to W. J. Ashworth on Jul. 16, 1991 entitled "Method for Attaching an Audio Transducer to a String Musical Instrument" discloses a method for electrically producing a sound from a stringed instrument whereby an audio transducer is attached to the strings. The vibrations produced by the audio transducer can be used both to accelerate the aging process, or the sound emitted by the transducer can be superimposed over the sounds emitted by playing the instrument manually. Such arrangement although capable of being used to continually vibrate the instruments strings otherwise is unlike the present invention.

U.S. Pat. No. 5,212,330 issued to M. P. Cooper on May 18, 1993 entitled "Mechanical Guitar Strummer" discloses a device for enabling handicapped individuals to play a guitar using two foot pedals operably connected to a device mounted over top of the strings. One pedal is used to move a pick across the strings, and the other pedal is used to engage and disengage the pick from contacting the strings. Such device is structurally unlike the present invention.

U.S. Pat. No. 5,537,908 issued to S. W. Rabe on Jul. 23, 1996 entitled "Acoustic Response of Components of Musical Instrument" discloses essentially a vibration machine, wherein a stringed instrument is strapped to the flat upper surface of the machine and then vibrated at different frequencies to artificially age the wood. Rabe thus vibrates the entire instrument in a vibration unit rather than producing vibrations by continually strumming the strings using a conventional guitar pick as in the present invention.

U. S. Pat. No. 5,600,081 issued to L. G. Simjian on Feb. 4, 1997 entitled "Method of Improving the Sonority of a Musical Instrument" discloses a wood treating method wherein the wood of a musical instrument is subjected to sonic energy in a frequency range between 5 kHz and 100 kHz. Such treatment is applied during building of the instrument, or at least before the surface is treated with a lacquer, and overall is unlike the present inventor's strummer device.

U.S. Pat. No. 7,227,068 issued to C. L. Van Doren on Jun. 5, 2007 entitled "String-Mounted Conditioner for Stringed Musical Instruments" discloses a vibration emitting device that is attached to one or more of the strings of a musical instrument, for transmitting to the strings and then the body of the instrument. In a preferred embodiment, the vibration means is a motor with an asymmetric cam. The Van Doren device does not strum the strings of an instrument to cause vibrations as in the present invention.

In addition, other methods for conditioning the wood of a stringed instrument such as by placing the instrument near a loudspeaker, have generally not been as effective or efficient as using the strings to cause such vibrations, or have a greater potential to reduce the structural integrity of the instrument.

Although the above instrument conditioning devices and processes may be suitable for their particular purposes, they either must be administered during the manufacturing process or are both complicated and expensive, and in general do not offer the advantages of the present inventors device, which is designed to enable musicians to simply and easily accelerate the aging process of a string instrument such as an acoustic guitar at home or on the road at any convenient time. Another drawback of known wood instrument aging devices is that today manufacturers of instruments place a greater emphasis on production speed and efficiency, and particularly for mass produced instruments such manufacturers are reluctant to subject each instrument to a comprehensive conditioning regimen prior to sale. There is therefore, despite these existing devices and methods, a need for a device that will enable both professional and recreational musicians to condition or accelerate the breaking in or aging process of their personal wood instruments such as an acoustic guitar at home or on their own so that the instrument produces a richer, more uniform sound when played. In addition, it is desirable particularly with respect to acoustic guitars that the guitar be aged or vibrated in a manner that closely simulates actual playing of the instrument, wherein the strings of the instrument are continually contacted by a guitar pick, also known as a plectrum, to transmit the vibrations to the sounding board of the instrument.

OBJECTS OF THE INVENTION

The present invention is directed to devices for conditioning or prematurely aging stringed instruments such as an acoustic guitar so that the instrument produces richer and more uniform tones or sounds, and more particularly to an inexpensive, easy to user automatic guitar strumming device.

It is a still further object of the invention to provide a guitar strumming device that individual musicians or guitar owners can use to more quickly break in or age their personal stringed instruments such as acoustic and electric guitars than could be accomplished simply by normal playing or use of such instruments.

It is a still further object of the invention to provide a strummer device for accelerating the aging process of a stringed instrument such as a guitar by continually vibrating the strings of such instrument that is stylish, lightweight, as well as inexpensive and easy to use and set up.

It is a still further object of the invention to provide a device for breaking in stringed instruments on a long term basis thereby adding to the value of the instrument.

Still other objects and advantages of the invention will become clear upon review of the following detailed description in conjunction with the appended drawings.

SUMMARY OF THE INVENTION

A simple but effective long term conditioning device particularly for home or living quarters use is provided to continuously pluck or strum the strings of a stringed musical instrument during periods when such instrument is not in use to over an extended but not necessarily continuous period "break in" the instrument, thereby enabling a musician to break in his or her own stringed instrument more quickly and cheaply than is practical for a manufacturer of instruments. The strummer of the invention comprises a light stringed instrument stand or holder for supporting the stringed instrument in a rack-type holder provided on one side with a reciprocating laterally moving arm or strummer arm attached to motor means to effect oscillating or reciprocating movement laterally of such arm across the strings of the instrument with a plectrum extending from the arm to generally contact the string of the instrument on a continuously or semi-continuous basis. The position of the arm and plectrum may be adjusted to accommodate stringed instruments of different sizes and dimensions, or to adjust the contact position of the plectrum with respect to the strings.

BRIEF DESCRIPTION OF THE APPENDED DRAWING

DETAILED DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

The present invention is directed to a device for conditioning and accelerating the aging process of a stringed instrument such as an acoustic guitar through continual playing of such instrument, whereby by using such device the strings of the instrument are continually plucked or strummed and vibrated, which vibrations are transferred to the wooden body of the instrument. While the exact structural changes taking place in the wood as a result of such vibration is still the subject to debate, it is generally accepted that over time the more a quality stringed instrument is used, the more uniform and often richer sound is produced by such instrument. Although a great deal or amount of care and attention to detail is required to manufacture a quality stringed instrument such as an acoustic guitar or violin, manufacturers of such instruments are nevertheless often reluctant to subject each instrument body to a prolonged conditioning program, primarily due to the costs associated with such processes as well as the time involved, which conflicts with the commercial need to manufacture and sell as many instruments as quickly and economically as possible. There is thus a need for a device that purchasers of both high and lesser quality stringed instruments having a wooden body can use to further condition or accelerate the aging process of the instrument so that such instrument produces a richer and more uniform sound when played. Recognizing such need, the present inventors have developed an attractive and economical motorized strummer device that can be used with stringed instruments of different sizes such as an acoustic guitar to continually pluck or strum the strings of the instrument using a conventional pick or plectrum, with the vibrations of the strings being continually transferred to the wooden instrument body.

Figure 1:
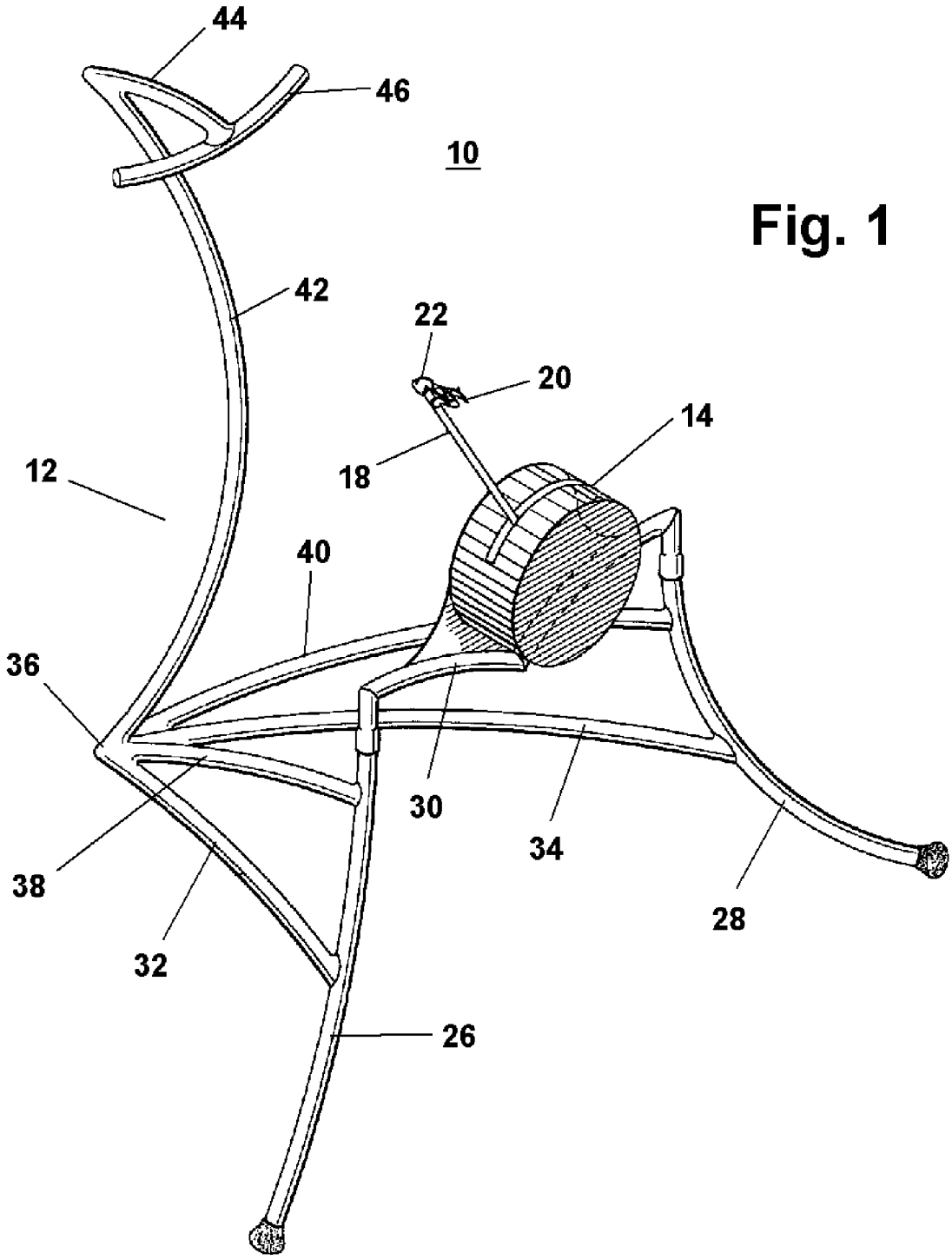
FIG. 1 is a perspective view of a preferred embodiment of a guitar strumming device in accordance with the invention.
Figure 4:
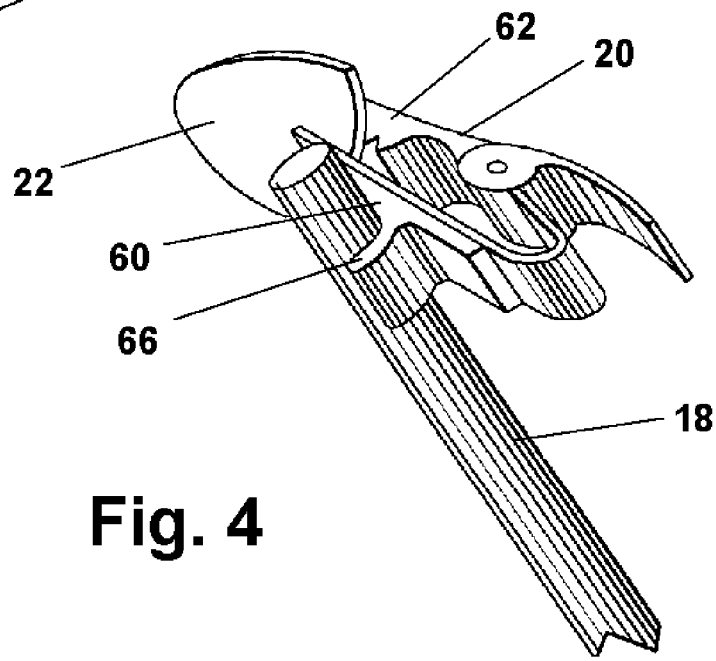
FIG. 4 is a partial view of the plectrum holder or clip of the invention.
Figure 5:
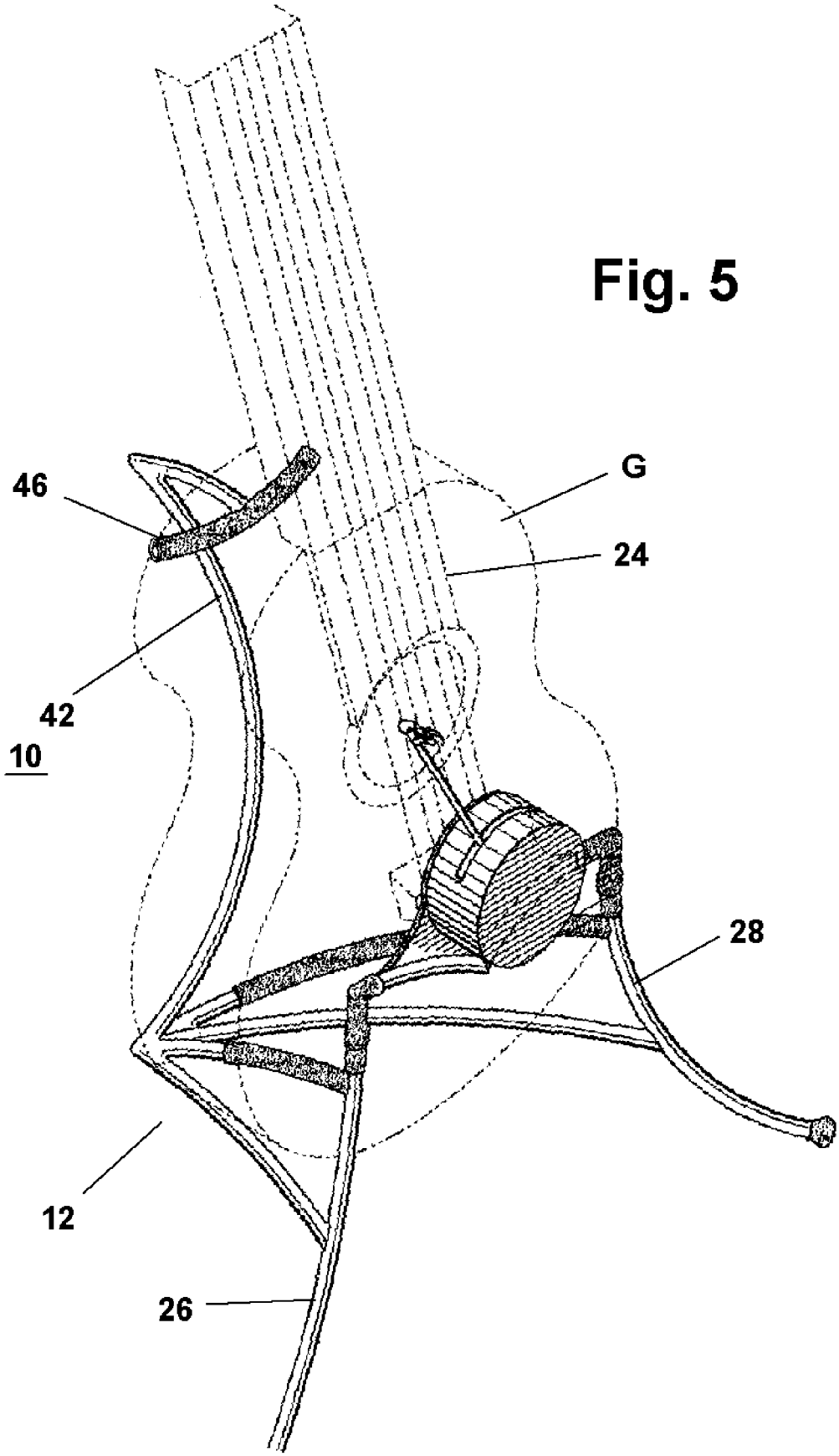
FIG. 5 is perspective view showing a guitar supported on the device of the invention.
Figure 6:
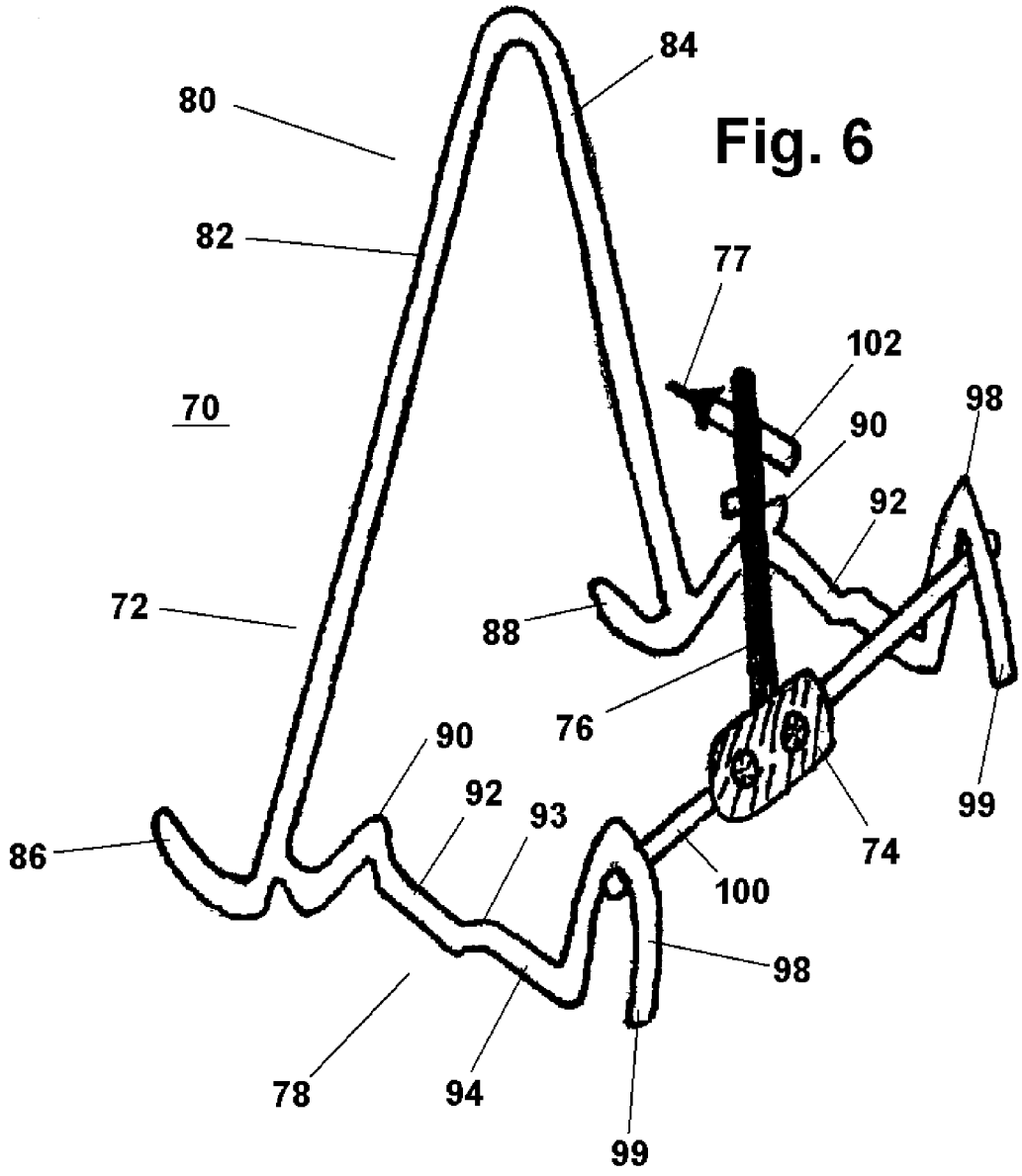
FIG. 6 is a perspective view of an alternative embodiment of the invention.

FIGS. 1-5 illustrate a first preferred embodiment of an instrument conditioning device in accordance with the present invention, while FIG. 6 illustrates an alternative embodiment of such device. Referring now to FIGS. 1-5, there is shown an instrument conditioning device 10 comprised of a support stand 12 having a motor housing 14 connected thereto for supporting a motor 16 (see FIG. 3), and an oscillating rod 18 which is operably connected to motor 16. In addition, a clip member 20 is adjustably secured to rod arm 18, which clip member 20 holds a plectrum 22 in a position as shown in FIG. 5 so that as the rod 18 is moved by motor 16 laterally over the strings 24 of a guitar G or other stringed instrument in a reciprocating motion, the plectrum will repeatedly contact the strings and vibrate the wooden body of the instrument. Support stand 12 as shown in FIG. 1 may be constructed from a single piece of a suitable material such as aluminum, steel, plastic, metal or other suitable material that is molded or formed into the configuration described herein, and may be tubular in nature. Alternatively, the stand may be formed from a plurality of individual pieces which are joined together either by soldering or other suitable means depending upon the materials of construction.

Stand 12 is generally of a rack-type and includes a pair of upstanding front legs 26 and 28, the ground contacting ends of which legs 26 and 28 are shown as being angled slightly outwardly to increase the stability of the stand. Front legs 26 and 28 are joined at their upper ends by a crossbar 30. Extending rearwardly from front legs 26 and 28 and angled slightly downwardly and converging inwardly are structural supports 32 and 34, respectively, which supports are joined together at hub 36. In addition, guitar body support members 38 and 40 also extend rearwardly and downwardly from front legs 26 and 28, respectively, at a position above supports 32 and 34 and converge so as to be joined at hub 36, which hub also serves as a third ground contacting point. Meanwhile, neck member 42 extends vertically upwardly from hub 36, with short link 44 connected extending generally forwardly from the upper end of neck member 42 towards crossbar 40 and having instrument backrest support rod 46 attached at its outer end, extending transversely to link 44.

Figure 2:
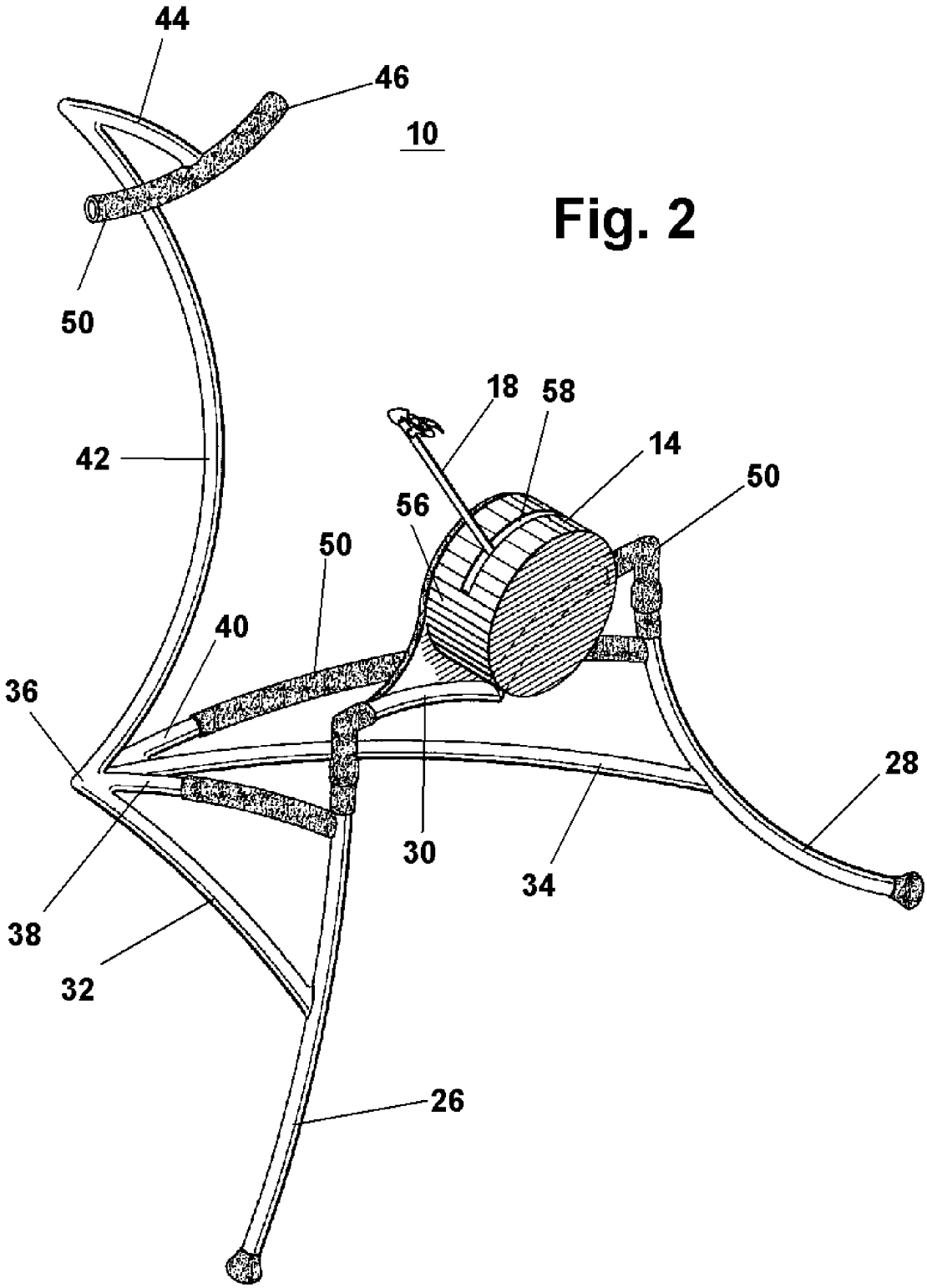
FIG. 2 is a perspective view of the guitar strumming device of FIG. 1 with padding applied strategically to certain portions of the device to protect the instrument utilized with the device.
Figure 3:
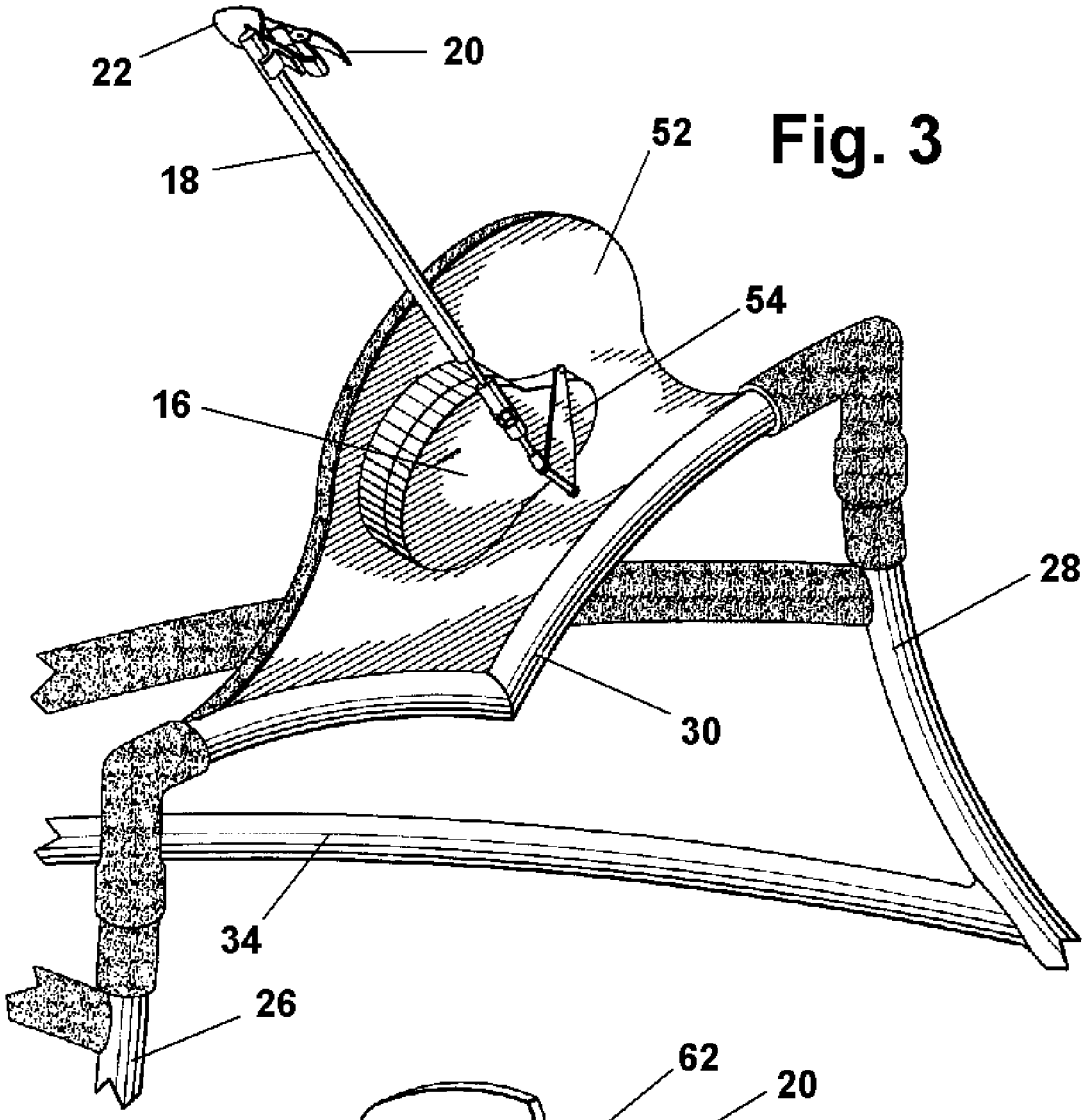
FIG. 3 is a close-up view of the motor support section of the device.

In FIG. 2, conditioning device 10 is shown having a padding or cushioning material 50 such as foam rubber or the like strategically applied to certain areas of stand 12, particularly where an instrument such as guitar G will come into direct contact with the stand to prevent the instrument being scratched. In addition, padding or cushioning material 50 is made of a non-slip material and will aid in preventing guitar G from slipping and hold it in a stationary upright position on stand 12 during the conditioning process as will be explained below. As shown, padding or cushioning material 50 is applied on guitar support arms 38 and 40, backrest support rod 46, the rear surface of the motor housing, and the corners formed by the upper ends of front legs 26 and 28 and crossrod 30, although such padding may be applied over the entire surface of stand 12. In addition, rubber or other non-slip feet may be applied to the ground-contacting ends front legs 26 and 28, as well as the underside of hub 36.

Motor housing 14 is connected at a central location to cross rod 30. As shown in detail in FIG. 3, the motor housing 14 includes a vertically disposed support surface 52 which is preferably formed integrally with or is otherwise permanently connected to crossrod 30, with motor 16 being mounted directly to support surface 52. Motor 16 may be of any type known in the prior art as being suitable for the present purposes, and preferably is a small electric motor. A linkage assembly 54 is utilized to connect the lower end of rod 18 to the drive shaft of motor 16, which linkage assembly is of a type known in the prior art for converting the rotary motion of motor 16 into an oscillating or reciprocating pendulum type motion of rod arm 18. Rod arm 18 extends generally upwardly and may be angled slightly rearwardly in relation to the motor housing 42 and stand 12, and as shown in FIGS. 1-2, extends through slot 58 in the upwardly facing surface of removable cover section 56 of motor housing 14. As the motor drive shaft turns, rod arm 18 is moved in a back and forth or side-to-side motion by any suitable known rotary to reciprocating movement translation device such as generalized linkage assembly 54. Rod arm 18 may also be adjustable up and down in relation to motor housing 42 so that the length of the rod arm can be adjusted. Motor 16 preferably will have an on/off switch, and may have variable speed settings such as low, medium and high speeds enabling the speed with which strummer arm 16 moves across the strings, as well as the intensity of the resulting vibrations of the strings to be varied. However, a single speed motor may be utilized.

Referring now to FIG. 4, rod arm 18 is preferably made of a rigid plastic or metal material. As illustrated, clip 20 is a spring clip having a pair of parallel arms or jaws 60 and 62 between which plectrum 22 is secured. Clip 20 is attached to rod 18 by clamping arm or arms 66 which frictionally engage the side surface of rod 18, and also preferably allow the position of clip 20 on rod 18 to be slidably adjusted. Alternatively, clip 20 may be permanently secured to rod 18 in a suitable position as shown in FIG. 4 so that plectrum 22 is directed rearwardly with respect to crossrod 30, although by allowing for the vertical position of clip 20 to be adjusted conditioning device 10 can be more easily adjusted for use with different size instruments. Other suitable arrangements for securing clip member 20 to rod 18 at different positions, or for holding plectrum 22, may be provided.

In use, as illustrated in FIG. 5, a stringed instrument having a wooden body such as acoustic guitar G is placed on support stand 12 of conditioning device 10, with the lower end of the guitar body resting on support rods 32 and 34' and with the rear surface of the guitar body leaning against backrest 46. More particularly, the center of the lower end of the guitar body is disposed between supports 32 and 34 which contact the side surface of the guitar body at two points more or less equidistant from the lower end of the guitar body on opposite sides. As a result, most of the weight of the guitar is supported on support rods 32 and 34, and since rods 32 and 34 are angled downwardly towards the rear of stand 12 the guitar body is leaning back so that the rear surface of the guitar body naturally leans against backrest support 20, creating a very stable support for the instrument. The configuration or contour of backrest 46 may be altered as desired so that the rear surface of the guitar body is in contact with substantially the entire length of the backrest, or so that the backrest contacts the guitar body at two spaced apart points near the ends of the backrest 46. Other means for securing the instrument body in stand 12 such as providing a strap attached to vertical rod 42 which may be looped and tightened around the guitar body may also be included to provide additional stability, although it is not believed that such additional securing means are necessary under normal use conditions.

A plectrum 22 is then secured (if not already attached) to reciprocating arm 18 with the tip of the plectrum in an overlapping relationship with guitar strings 24. Depending on the size of the instrument, the position of clip 20 on reciprocating arm 18 may also be adjusted if necessary so that the tip of plectrum 22 comes into contact the guitar strings at a desired position. In an acoustic guitar, this will normally be centered over the circular opening in the soundboard of the guitar, so that strumming of the strings with plectrum 22 will cause maximum vibrations to be carried into the vibration chamber of the guitar body. The position of the plectrum may also be adjusted for use with other varieties of guitars or other stringed instruments. The exact position of plectrum 22 in between jaws 60 and 62 of clip 20 may also be adjusted slightly, thereby enabling the user to determine the depth the tip of the plectrum extends between the strings as the reciprocating arm is moved back and forth across the strings, thereby adjusting the loudness and intensity of the vibrations produced. A replacement plectrum may be substituted as needed or desired.

FIG. 6 illustrates an alternative embodiment of the instrument conditioning device of the present invention. In FIG. 6, conditioning device 70 is comprised of an instrument support stand 72, a motor housing 74, and a reciprocating rod arm 76 controlled by an electrically energized motor, not shown, mounted in motor housing 74, with a plectrum 77 attached to the end such arm 76 for continuously contacting and vibrating the strings of a stringed instrument placed in stand 72 as has already been discussed with reference to the previously described embodiments. Support stand 72 may be constructed from a single piece of a suitable material such as aluminum or another suitable metal or plastic that is bent or otherwise molded or formed into the configuration described herein. Alternatively, the stand may be formed from two or more individual pieces that have been joined together either by soldering or other suitable means depending upon the materials of construction. Stand 72 includes a bottom support section 78 for supporting a guitar placed in the stand, and a back support section 80 for supporting the back of a guitar body placed in the support. Back support section 80 has an A-shaped frame formed by first and second angle members 82 and 84, while foot members 86 and 88 extend rearwardly from the lower ends of angle members 82 and 84, respectively.

Bottom support section 78 extends forwardly from back support section 80, at a position generally opposite foot members 86 and 88. Bottom support section 78 in the present embodiment is contoured to accommodate and support the lower body portion of either an acoustic guitar or an electric guitar having a conventional size and width without slipping on stand 10. Acoustic guitars, of course, have a hollow body and thus in general the body of an acoustic guitar is wider than that of an electric guitar, which guitar bodies are made of solid wood and do not require a vibration chamber. To accommodate such different sizes, bottom support section 78 has a first generally flat or horizontal section 92 extending forwardly from upwardly projecting tab or stop 90. Section 90 is wide enough to accommodate the body of a typical electric guitar being supported in an upright in the stand 70, with the rear surface of the guitar body leaning or resting against angle members 82 and 84 of back support section 80. In addition, a second horizontal section 94 extends forwardly from first horizontal section 92, at which connection point there is a slight upward bend or turn 93 so that second horizontal section 94 is slightly elevated with respect to first horizontal section 92. The combined width of first and second horizontal sections 92 and 94 is sufficient to accommodate the body of a typical acoustic guitar placed in stand 72 in an upright position, with the rear surface of the acoustic guitar body resting against back support section 80. The bottom edge of an electric guitar placed in stand 72 and leaning against back support section 80 will be prevented from sliding forwardly out of first vertical section 92 by the slight upward bend 93 leading to second vertical section 94. A scratch-proof coating or cushioning material such as foam rubber or the like will preferably be placed over at least those areas of support stand 72 on which a guitar resting in stand 70 will normally come into direct contact with the stand.

Adjacent the forward end of second vertical sections 94 are a pair of smaller generally A-shaped members 98, the end of the forwardmost leg 99 of such members 98 serving as front foot members or supports for stand 72. Crossbar 100 is secured between the apex of members 98, and motor housing 74 is mounted centrally on crossbar 100. The motor housed in motor housing 74 may be any suitable small electric motor of a type known to those skilled in the art. Attached to the drive shaft of motor 74 on one end is reciprocating rod arm 76. Rod arm 76 extends generally in a vertical direction in relation to motor housing 74, and is secured to the motor drive shaft so that as the drive shaft turns, rod arm 76 is caused to be moved in a back and forth or side-to-side motion, using a suitable known rotary to reciprocating movement translation linkage system, not shown, across the strings of an instrument resting in stand 72. Rod arm 76 is also preferably adjustable up and down in relation to motor housing 74 so that the length of the rod arm can be adjusted. For example, a screw clamp means may be used to secure rod arm 76 to a motor drive shaft rod. Plectrum support arm 102 is secured to the upper end of rod arm 76 so that it extends generally perpendicular to rod arm 76 toward back support 80. The position of strummer arm 102 is also preferably adjustable on rod arm 76 via a screw clamping means or other suitable locking means. Finally, a plectrum 77 is secured to the inwardly facing end of strummer arm 102 by a spring clip, although other suitable holding means of a type known in the prior art may also be used. The angle of strummer arm 102 with respect to rod 76 is also preferably adjustable at least to some degree.

Once adjusted, an electrical cord connected to the motor or to an auxiliary motor speed control apparatus may be plugged into an electrical outlet, and the motor then turned on, which will cause rod arm 76 to swing or move back and forth repeatedly across the front face of the guitar body a distance sufficient for the plectrum 77 to come into contact with and cause to vibrate each of the guitar strings.

In any of the embodiments of the present invention, the instrument conditioning device may be left running for an extended period of time, essentially as long as is desired, during which entire time the strings of the instrument will be contacted by the plectrum repeatedly and discontinuously over a period determined by the application of electric power to the apparatus and on a regular cycle, and the vibrations caused by the strings will transferred to the wooden guitar structure. A new plectrum may be connected to the reciprocating arm assembly whenever necessary.

It will usually be convenient to use rubber or other coverings for the support surface contact portions of the strumming apparatus of the invention to essentially provide better contact of the apparatus of the invention with such supporting surface to prevent any vibrational noises during operation as well as to prevent "walking" of the apparatus across such surface. While the continuous strumming of the strings necessarily will cause continuous musical tunes, such tunes will normally not be unpleasant to a musician even though not in any varied cadence or tune and over time noises coming from a musical instrument may be less objectionable to a musician than a cadence or tune repetitiously repeated even to a musician in such musician's living quarters. On the other hand, however, some may find the continual operation of the conditioning device to be distracting or even eventually annoying, particularly at times when he or she is attempting to sleep, watch television, talk on the phone, or perform a task that requires a modicum of attention or concentration. Therefore, in an another alternative embodiment of the present invention, as a further improvement the present inventors will provide a case in which the conditioning device as well as the instrument can be mounted during use, which case preferably will be soundproof and therefore will serve as a soundproof environment in which the device can be operated. Such case would require only an opening for inserting and removing the conditioning device and instrument, as well as an aperture through which an electrical cord could extend, and a ventilation means for the electric motor, which motor could also be adapted to be situated on the outside of the case. In addition, while the majority of the case could be made from a flexible material including a soundproof layer or barrier, it is envisioned that at least over the front surface of the conditioning device where the rod arm is moving back and forth in a reciprocating motion, and where the strings are being caused to vibrate, the casing will include a more rigid structure or layer, or may also include a spacing means that will extend between the instrument or conditioning device and the inner surface of the case so that the case material does not interfere with the operation of the device or production of vibrations in the soundbox portion of the instrument. It is also preferred that at least a portion of the front surface of the case have a transparent window area so that the user can view the conditioning device at a glance and determine whether or not it is activated.

While there are several different theories to explain exactly what structural changes the continuous vibrations cause to occur to the wood of an instrument, it is generally accepted that the resulting instrument produces a more uniform and therefore higher quality sound the more it is played. Thus, the present invention is designed to accelerate this process of breaking in a stringed instrument by increasing the number of hours the instrument is effectively played, to "break in" such instrument more quickly. While the present device is illustrated as being for use with acoustic and electric guitars, such device may also be adapted for use with other stringed instruments, such as a cello, violin, as well as special types of guitars or wood instruments such as a Dobro® resonator guitar.

In another variation of the device of the invention, a reciprocating plucking arm may be mounted in a housing provided with a support or attachment means that may be clamped onto the lower forward section of an existing stringed instrument support for use for exact display of such stringed instrument or a stringed instrument support for temporary storage of unused instruments during a musical stage performance. Such racks then can be used to support the instruments in the living quarters of a musician with the strumming apparatus clamped to the front of the support in a position to swap its arm and plectrum past and in intermittent contact with the straps of the supported instrument.

In a still further embodiment of the invention, the base of instrument conditioning device of the invention may be made to fold for easy storage when not in use but easily erectable for use in a musicians living quarters during nonuse of a stringed instrument for long term strumming of the strings to aid in breaking in the instrument. A well broken instrument being more valuable than a new unbroken instrument, the apparatus of the invention can rather quickly pay for itself.

While the present invention has been described at some length and with some particularly with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention

We claim:

1. A device for accelerating the conditioning process of a wooden stringed instrument comprising:

(a) a stand for supporting a stringed instrument in a generally upright position, including a bottom support section contoured to support the lower body portion of the instrument along its side surfaces, and a backrest section extending upwardly with respect to said bottom support section; and (b) a motorized arm attached to said stand for holding a plectrum and moving the plectrum back and forth across the instrument strings in a reciprocating motion; and;

(c) a clip member secured to said motorized arm for adjustably securing the plectrum to said motorized arm.

2. The device of claim 1 in which the angle and length of said motorized arm is adjustable.

3. The device of claim 1 additionally comprising a padded scratch resistant covering on the guitar support stand at the points where the instrument directly contacts the stand when placed on said stand.

4. The device of claim 1 in which said stand additionally comprises a pair of spaced apart front leg members, a crossbar extending between said leg members, and the motor of said motorized arm supported in a motor housing secured to the crossbar, and the motorized arm extending upwardly from said motor housing.

5. The device of claim 4 in which said bottom support section is comprised of a pair of support members each connected on one end to one of said leg sections, and extending rearwardly following a generally downwardly sloping and converging arcuate path, with the rearwardly disposed ends of said leg sections being secured together at a hub, said hub forming the rear ground support for the device.

6. The device of claim 5 in which said backrest section extends upwardly from said hub.

7. The device of claim 1 in which the position of said plectrum in relation to the longitudinal axis of the instrument strings is adjustable laterally to allow for a light to medium to heavy strumming.

8. The device of claim 3 wherein said covering is a foam material.

9. The device of claim 4 wherein the speed of said motor is adjustable.

10. A lightly built device adapted for personal or home use for discontinuously plucking or strumming the strings of a stringed instrument comprising:

a) a base adapted to be evenly held upon a supporting surface;

b) said base having an upper surface adapted to support a stringed instrument in a semi-upright position with the strings facing a laterally reciprocating arm operated by an electric motor movable past the strings of the instrument from side to side;

c) said base formed of a rod member bent so that said upper surface has at least four support surface contacting surfaces and a substantially upright instrument support in the back; and d) means to support a plectrum upon the laterally reciprocating arm in a position to intermittently stroke the strings of the stringed instrument with the plectrum.

11. A device for accelerating the conditioning process of a wooden stringed instrument comprising:

(a) a stand for supporting a stringed instrument in a generally upright position having a pair of spaced apart front leg members, a crossbar extending between said leg members; and (b) a motorized arm attached to said stand for holding a plectrum and moving the plectrum back and forth across the instrument strings in a reciprocating motion, the motor of said motorized arm having an adjustable speed and supported in a motor housing secured to the crossbar, and the motorized arm extending upwardly from said motor housing.

12. The device of claim 11 in which said stand additionally comprises a bottom support section contoured to support the lower body portion of the instrument along its side surfaces, and a backrest section extending upwardly with respect to said bottom support section.

13. The device of claim 11 wherein the angle and length of said motorized arm is adjustable, and the position of said plectrum in relation to the longitudinal axis of the instrument strings is adjustable laterally to allow for a light to medium to heavy strumming.

14. The device of claim 11 additionally comprising a clip member secured to said motorized arm for adjustably securing the plectrum to said motorized arm.

15. The device of claim 11 additionally comprising a padded scratch resistant covering on the guitar support stand at the points where the instrument directly contacts the stand when placed on said stand.

16. The device of claim 12 in which said bottom support section is comprised of a pair of support members each connected on one end to one of said leg sections, and extending rearwardly following a generally downwardly sloping and converging arcuate path, with the rearwardly disposed ends of said leg sections being secured together at a hub, said hub forming the rear ground support for the device.

17. The device of claim 16 in which said backrest section extends upwardly from said hub.

* * * * *